US006329956B1

(12) United States Patent
Tateishi et al.

(10) Patent No.: US 6,329,956 B1
(45) Date of Patent: Dec. 11, 2001

(54) SATELLITE COMMUNICATION ANTENNA APPARATUS

(75) Inventors: Taizo Tateishi; Yukihisa Hasegawa, both of Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/624,999

(22) Filed: Jul. 25, 2000

(30) Foreign Application Priority Data

Jul. 30, 1999 (JP) ..... 11-217156

(51) Int. Cl.[7] ..... H01Q 19/06

(52) U.S. Cl. ..... 343/753; 343/754; 343/766; 343/911 L

(58) Field of Search ..... 343/753, 754, 343/909, 911 L, 911 R, 878, 882, 757, 758, 763, 765, 766

(56) References Cited

U.S. PATENT DOCUMENTS 4,531,129 * 7/1985 Bonebright et al. ..... 343/754
5,703,603 * 12/1997 Korzhenhov et al. ..... 343/753
5,748,151 * 5/1998 Kingston et al. ..... 343/753

* cited by examiner

*Primary Examiner*—Don Wong
*Assistant Examiner*—Hoang Nguyen
(74) *Attorney, Agent, or Firm*—Oblon, Spivak, McClelland, Maier & Neustadt, P.C.

(57) ABSTRACT

A satellite communication antenna apparatus for performing communication with a communication satellite, comprises a spherical radio wave lens, an arcuate guide unit arranged along an outer surface of the radio wave lens and having a central point common with the radio wave lens, an antenna unit reciprocally movable along the guide unit, and an antenna positioning unit for positioning the antenna unit, wherein the guide unit is made of a material with a low specific dielectric constant.

14 Claims, 5 Drawing Sheets

SATELLITE COMMUNICATION ANTENNA APPARATUS

CROSS-REFERENCE TO RELATED APPLICATIONS

This application is based upon and claims the benefit of priority from the prior Japanese Patent Application No. 11-217156, filed Jul. 30, 1999, the entire contents of which are incorporated herein by reference.

BACKGROUND OF THE INVENTION

The present invention relates to a satellite communication antenna apparatus which can track a plurality of communication satellites at high precision and transmit and receive radio waves to and from them.

A conventional satellite communication antenna uses a parabolic antenna to transmit and receive radio waves to and from one communication satellite.

In recent years, a communication system is proposed which transmits and receives radio waves to and from, e.g., two satellites, among a plurality of communication satellites, located at the optimum positions for communication. Preferably, this satellite communication system tracks a plurality of communication satellites by changing its position such that its antenna unit is directed toward the positions of the communication satellites, and transmits and receives radio waves to and from the communication satellites.

One of satellite communication antennas used in this communication system uses a spherical radio wave lens and an antenna unit movable on an arcuate guide rail, and positions the antenna unit at a position opposite to the communication satellite through the radio wave lens, so that it can perform communication efficiently with the communication satellite.

The conventional satellite communication antenna described above has the following problems. If the antenna unit is driven along the arcuate rail, the mechanism becomes complicated, and position detection is difficult to perform.

As a driving force transmitting method, a ball screw method and belt method are generally employed. With these methods, however, it is difficult to move the antenna unit along an arc. If a ball screw or belt is added, the resultant mechanism becomes expensive. A guide or driving force transmitting mechanism made of a metal may undesirably disturb the intensity distribution of the radio waves to be transmitted and received. In order to transmit and receive radio waves to and from a plurality of communication satellites, a plurality of antenna units must be moved, leading to a further complicated mechanism.

As a position detection means, one is available that outputs an analog signal in accordance with the position of the antenna unit by utilizing a change in electrostatic capacitance upon movement of the antenna unit, as in a dielectric electrostatic sensor disclosed in Jpn. Pat. Appln. KOKAI Publication No. 6-196917. This method, however, lacks linearity, and cannot perform precise position detection.

As a countermeasure, one is available that detects the reception level of the radio waves from the satellite and performs position detection in accordance with the level, as disclosed in Jpn. Pat. Appln. KOKAI Publication No. 9-51220. According to this method, the antenna can always be set in a predetermined direction toward the position of the satellite. This method, however, cannot be used when radio waves from the satellite cannot be received.

BRIEF SUMMARY OF THE INVENTION

It is an object of the present invention to provide a satellite communication antenna which can reliably transmit and receive radio waves to and from a communication satellite.

According to the present invention, there is provided a satellite communication antenna apparatus for performing communication with a communication satellite, comprising a spherical radio wave lens, an arcuate guide unit arranged along an outer surface of the radio wave lens and having a central point common with the radio wave lens, and an antenna unit reciprocally movable along the guide unit, wherein the guide unit is made of a material with a low dielectric constant.

According to the present invention, the guide unit is made of a material with a low relative dielectric constant so that it will not adversely affect the intensity distribution of the radio waves. Therefore, radio waves can be reliably transmitted to and received from the communication satellite.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
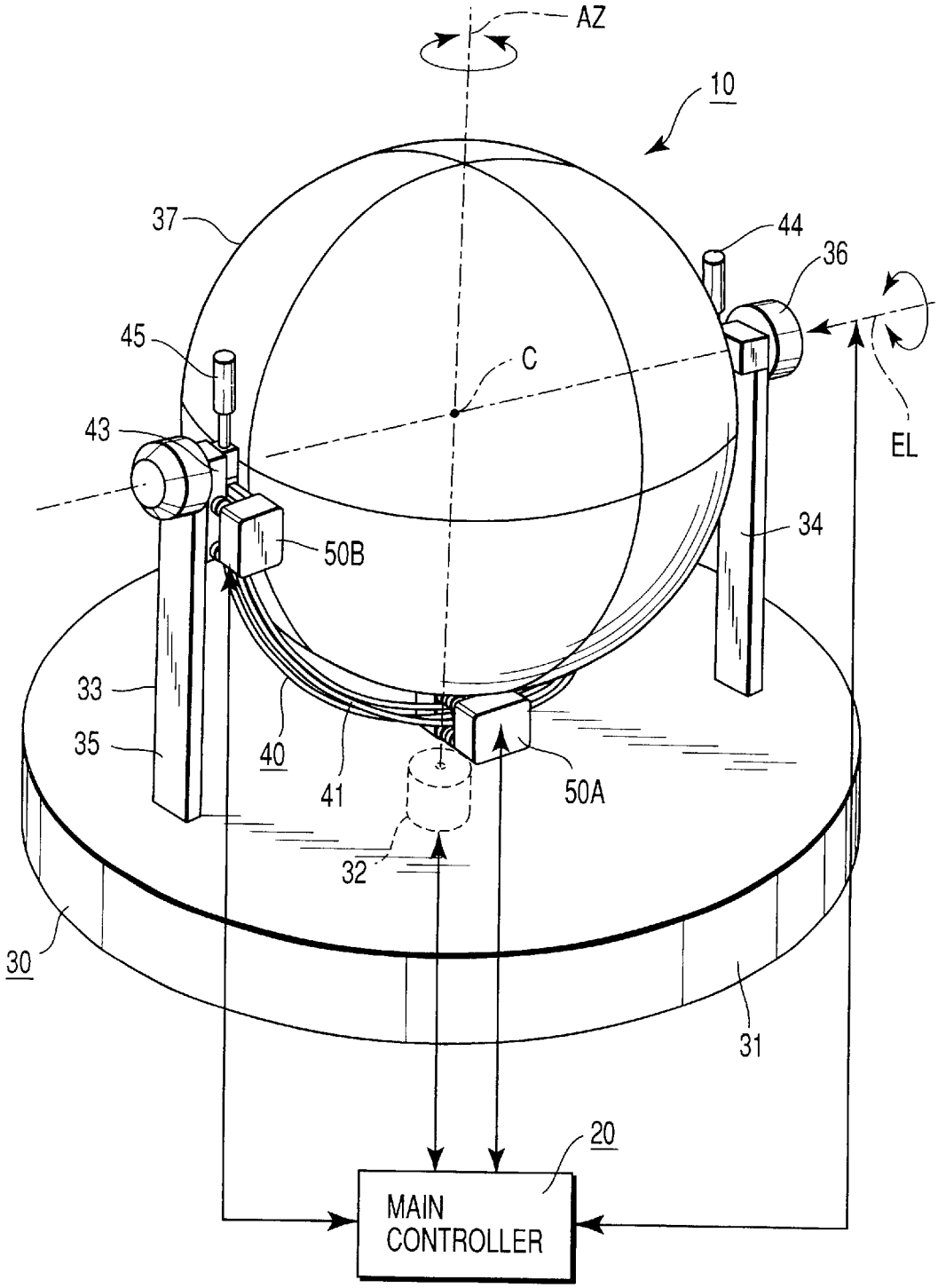
FIG. 1 is a perspective view showing a satellite communication antenna according to an embodiment of the present invention.
Figure 2:
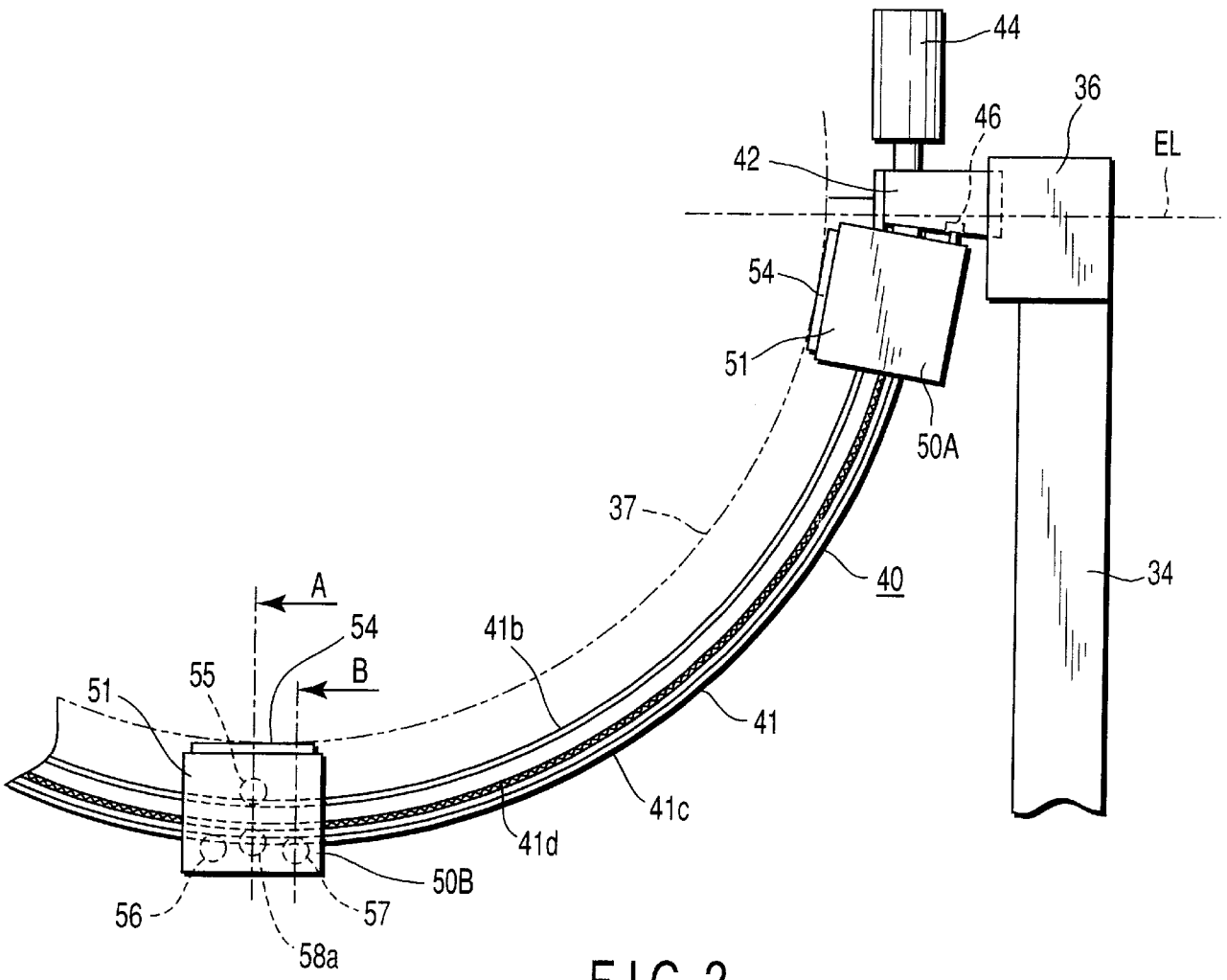
FIG. 2 is a side view showing the main part of a guide unit and antenna units incorporated in this satellite communication antenna.
Figure 3A:
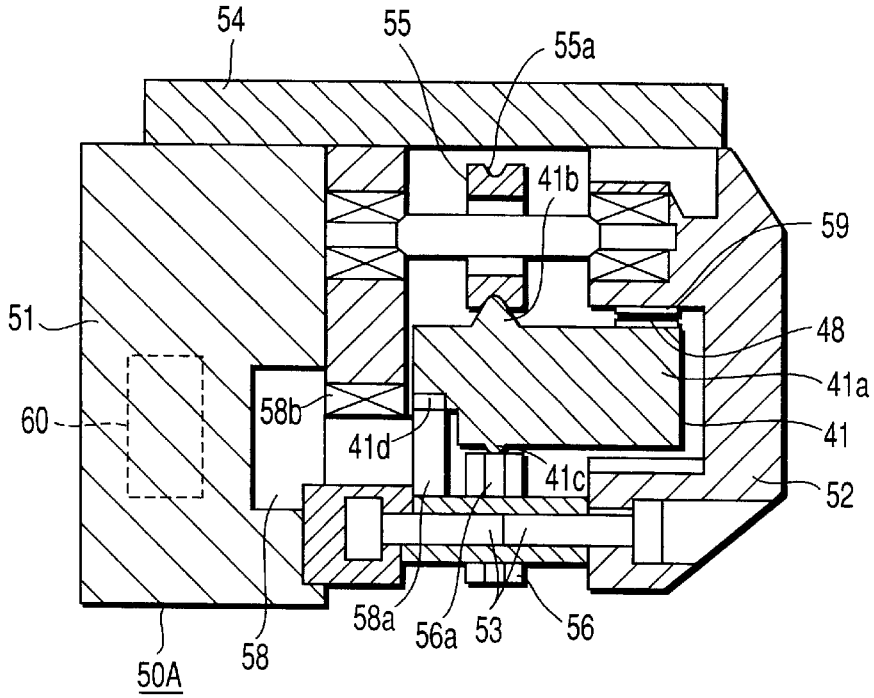
FIG. 3A is a sectional view taken along the line A—A of FIG. 2 to show the main part of the guide unit and antenna units incorporated in this satellite communication antenna from the direction of an arrow.
Figure 3B:
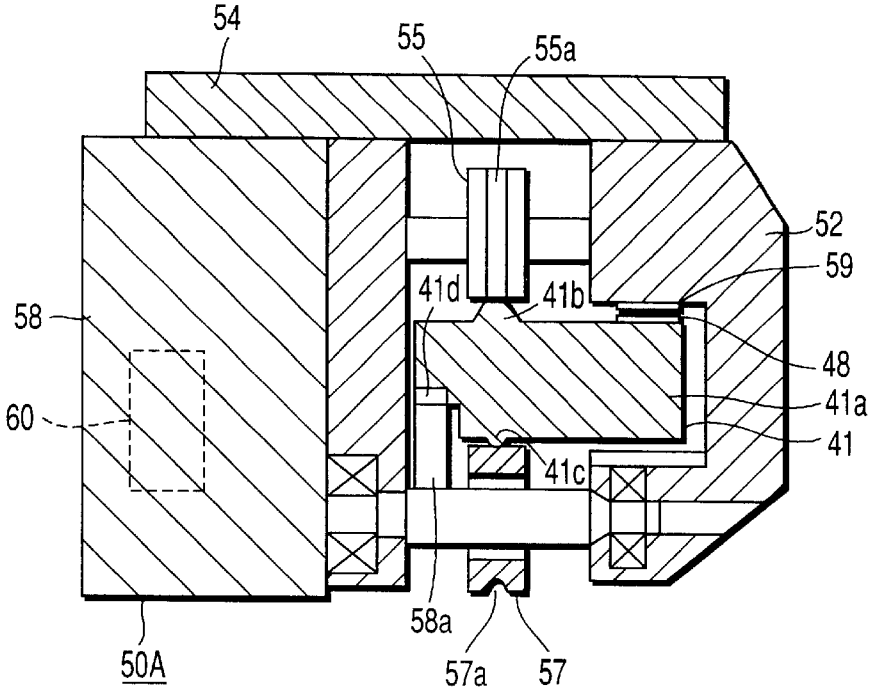
FIG. 3B is a sectional view taken along the line B—B of FIG. 2 and seen from the direction of an arrow.
Figure 4A:
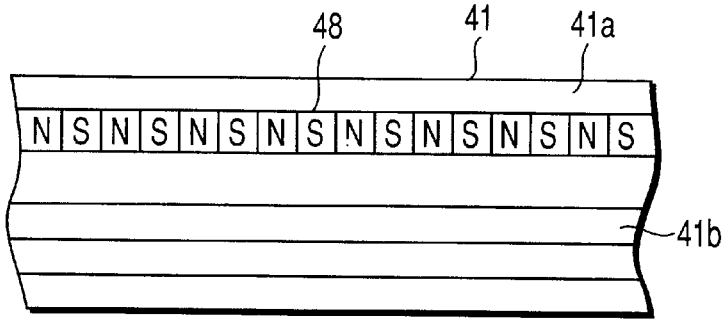
FIGS. 4A and 4B are plan views each showing a magnetic sheet incorporated in this satellite communication antenna.
Figure 4B:
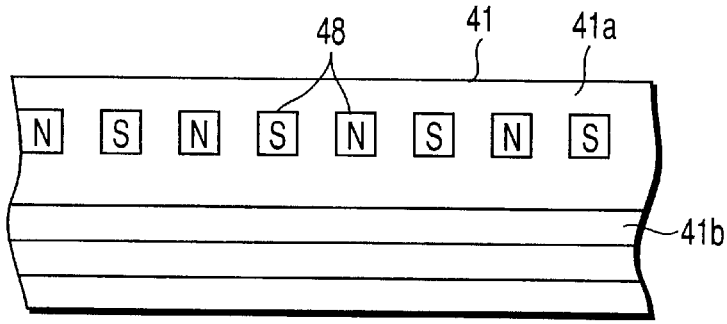
Figure 5:
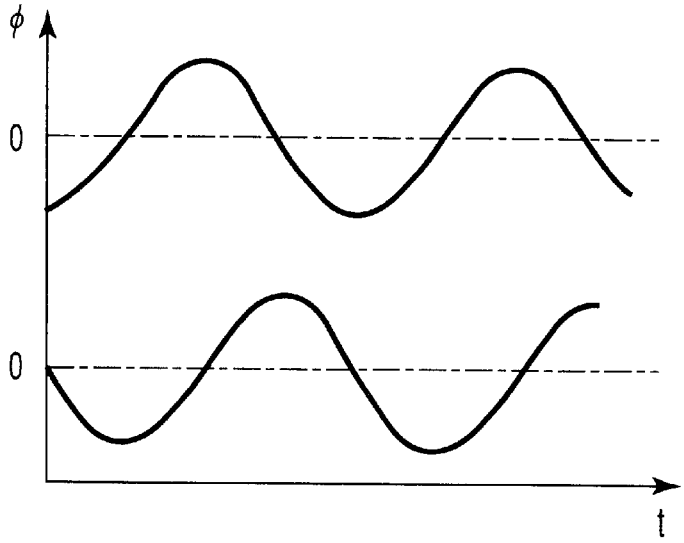
FIG. 5 is a graph showing outputs from an MR element incorporated in this satellite communication antenna.
Figure 6:
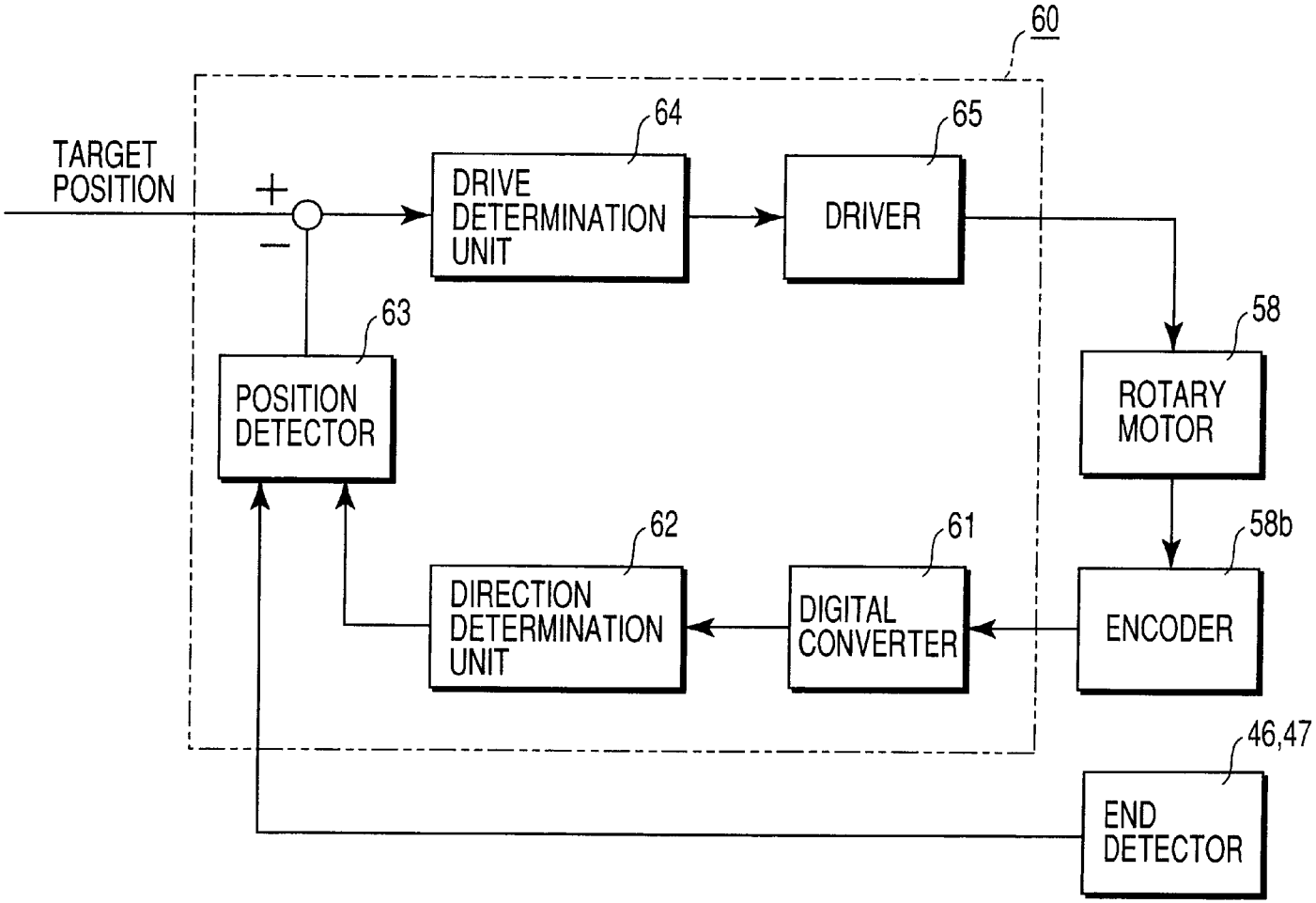
FIG. 6 is a block diagram showing the antenna position controller of this satellite communication antenna.

An embodiment of this embodiment will be described with reference to the accompanying drawing. FIG. 1 is a perspective view showing a satellite communication antenna 10 according to an embodiment of the present invention, FIG. 2 is a side view showing the main part of a guide unit 40 and antenna units 50A and 50B incorporated in the satellite communication antenna 10, FIGS. 3A and 3B are sectional views showing the main part of the guide unit 40 and antenna units 50A and 50B incorporated in the satellite communication antenna 10, FIGS. 4A and 4B are plan views each showing a magnetic sheet 48 incorporated in the satellite communication antenna 10, FIG. 5 is a graph showing outputs from an MR element 58 incorporated in the satellite communication antenna 10, and FIG. 6 is a block diagram showing an antenna position controller 60 of the satellite communication antenna 10.

The satellite communication antenna 10 is comprised of a main controller 20 and antenna mechanism 30.

The main controller 20 has a table which records the relationship between time and the position of the communication satellite. More specifically, the main controller 20 reads out the position of the communication satellite from the table on the basis of time at which transmission or reception is to be performed, and sends the positions of two communication satellites located at positions optimum for transmission or reception to the antenna mechanism 30 as the target positions.

The antenna mechanism 30 has a rotary table 31 and a table driver 32 for driving the rotary table 31 about the AZ-axis indicated by an alternate long and short dashed line in FIG. 1.

A guide rail support 33 for pivotally supporting a guide rail 41 (to be described later) vertically stands on the table driver 32. The guide rail support 33 is comprised of a pair of support pillars 34 and 35. A rotary motor 36 is provided to the support pillar 34. A spherical radio wave lens 37 is arranged between the support pillars 34 and 35. The radio wave lens 37 is a Luneberg lens.

The guide unit 40 has a guide rail 41 extending along the outer surface of the radio wave lens 37 to form an arc of 180 degrees. The central point of the arc of the guide rail 41 and the central point of the radio wave lens 37 described above coincide.

Two ends 42 and 43 of the guide rail 41 are attached to the support pillars 34 and 35 to be rotatable about the EL-axis indicated by an alternate long and short dashed line in FIG. 1. Counter weights 44 and 45 made of a material with a low dielectric constant, e.g., a resin, are attached to the two ends 42 and 43, respectively. End detectors 46 for detecting antenna units 50A and 50B (to be described later) are also attached to the two ends 42 and 43, respectively. The end detectors 46 comprise mechanical switches or non-contact sensors.

The guide rail 41 is formed of a member with a low specific dielectric constant, e.g., syndiotactic polystyrene. The specific dielectric constant of syndiotactic polystyrene is approximately 2.8. As the material of the guide rail 41, a resin with a lower dielectric constant than that of iron or copper, e.g., PBT, PPS, or LCP with a specific dielectric constant of 5 or less, may be used instead.

As shown in FIGS. 3A and 3B, the guide rail 41 is made up of a rail main body 41*a*, an engaging portion 41*b* projecting from the rail main body 41*a* on the inner circumferential side of the guide rail 41, an engaging portion 41*c* projecting from the guide rail 41 on the outer circumferential side of the guide rail 41, and a rack gear 41*d* formed along the extending direction of the guide rail 41. A magnetic sheet 48 is adhered to the rail main body 41*a*.

In the magnetic sheet 48, S poles and N poles are alternately arranged along the extending direction of the guide rail 41, as shown in FIGS. 4A and 4B. The magnetic sheet 48 is adhered to the end face of a disk and magnetized by rotation in advance. After that, the magnetic sheet 48 is adhered to the guide rail 41.

Two antenna units 50A and 50B are provided to be reciprocally movable along the guide rail 41. As the antenna units 50A and 50B have the same arrangement, they will be representatively described through the antenna unit 50A.

The antenna unit 50A has a main body 51 incorporating a rotary motor 58 (to be described later) and the antenna position controller 60, and a holder 52 attached to the main body 51 through the guide rail 41. The main body 51 and holder 52 are fixed to each other with bolts 53 or the like. A transmission/reception antenna 54 is mounted on the main body 51 and holder 52 in FIGS. 3A and 3B.

Rollers 55 to 57 are set between the main body 51 and holder 52. The centers of rotation of the rollers 55 to 57 are parallel to the axial direction of the arc that forms the guide rail 41. A recess 55*a* to engage with the engaging portion 41*b* (described above) is formed in the outer surface of the roller 55, and recesses 56*a* and 57*a* to engage with the engaging portion 41*c* (described above) are respectively formed in the outer surfaces of the rollers 56 and 57. The rollers 56 and 57 are biased by a leaf spring (not shown) or the like toward the guide rail 41.

In the embodiment described above, a set of rollers 55 to 57 supports the guide rail 41. To render the guide rail 41 more rigid in its axial direction, another set of engaging portions and another set of rollers may be provided to support the guide rail 41. In this case, the engaging portions of the other set extend parallel to the engaging portions 41*b* and 41*c*.

The main body 51 incorporates the rotary motor 58 such as a DC motor. The output shaft of the rotary motor 58 which is decelerated to about 1/30 forms a pinion gear 58*a* that engages with the rack gear 41*d*. More specifically, when the rotary motor 58 is operated, the main body 51 is moved along the guide rail 41. An encoder 58*b* is attached to the output shaft of the rotary motor 58, and the position of the antenna unit 50A is obtained on the basis of the rotation speed of the rotary motor 58.

The MR element 59 (magnetoresistive element) is also provided to the holder 52 to oppose the magnetic sheet 48 (described above). The MR element 59 obtains two types of outputs with different phases, and these outputs are input to a digital converter 61 (to be described later).

The main body 51 incorporates the antenna position controller 60. As shown in FIG. 6, the antenna position controller 60 has the digital converter 61 for converting analog signals from the encoder 58*b* and MR element 59 into digital signals, a direction determination unit 62 for determining the moving direction of the antenna unit 50A or 50B on the basis of the digital signals, a position detector 63 for detecting the position of the antenna unit 50A or 50B on the basis of a signal from the direction determination unit 62, a drive determination unit 64 for determining the driving direction and amount of the rotary motor 58 on the basis of a difference between signals from the position detector 63 and main controller 20, and a driver 65 for driving the rotary motor 58 on the basis of an instruction from the drive determination unit 64. The position detector 63 is calibrated to zero upon reception of a reset signal from the end detector 46.

The satellite communication antenna 10 having the above arrangement communicates with the communication satellites in the following manner. In the main controller 20, the positions of the communication satellites are read out from the table on the basis of time. The positions of two communication satellites located at positions optimum for transmission and reception are read out, and the target position of the antenna unit corresponding to the positions of the communication satellites through the radio wave lens 37 is instructed to the antenna mechanism 30.

In the antenna mechanism 30, the table driver 32 positions the rotary table 31 about the AZ-axis in FIG. 1 on the basis of the instructed target positions, and the rotary motor 36 positions the guide rail 41 about the EL-axis in FIG. 1.

The antenna unit 50A or 50B is then positioned. In this case, the antenna unit 50A or 50B is positioned by driving the rotary motor 58. The antenna unit 50A or 50B is moved to a position corresponding to the communication satellite through the radio wave lens 37 on the basis of a target instruction from the main controller 20.

The position of the antenna unit 50A or 50B is controlled by the antenna position controller 60. More specifically, a position signal from the encoder 58*b* of the rotary motor 58 and an analog signal from the MR element 59 are input to the digital converter 61. The digital converter 61 converts the analog signals into digital signals, and inputs them to the direction determination unit 62. The direction determination unit 62 can detect the moving direction on the basis of the signals from the MR element 59 which are phase-shifted by 90° from each other, because the combination of the two phases differs between a case wherein the antenna unit is moving forward and a case wherein it is moving backward.

Subsequently, the position detector 63 detects the position of the antenna unit 50A or 50B, and calculates the difference between the detected position and the target position. On the basis of this difference, the drive determination unit 64 calculates the moving direction and amount of the antenna unit 50A or 50B. Then, the rotary motor 58 is driven through the driver 65. As the rotary motor 58 has a minimum speed, when a change in target position becomes slower than the minimum speed of the rotary motor 58, the rotary motor 58 is driven stepwise, and the target position precision is maintained.

When the antenna unit 50A reaches the end 42 of the guide rail 41, the end detector 46 is turned on. When the antenna unit 50B reaches the end 43 of the guide rail 41, the end detector 46 is also turned on. When the end detector 46 is turned on, position information is reset, and the end 42 or 43 is recognized as the origin. Hence, a decrease in positioning precision of the antenna unit 50A or 50B caused by a cumulative error can be prevented.

In the above manner, the position of the antenna unit 50A or 50B can be obtained accurately by three types of encoders, so that the antenna unit 50A or 50B can be moved smoothly to the target position and positioned there.

The roller 55 of the antenna unit 50A or 50B engages with the engaging portion 41*b* of the guide rail 41, and the rollers 56 and 57 thereof engage with the engaging portion 41*c* of the guide rail 41. Therefore, the rollers 55, 56, and 57 are regulated from moving in a direction perpendicularly intersecting the extending direction of the guide rail 41, i.e., the axial direction of the arc that forms the guide rail 41. Also, since the rollers 56 and 57 are biased toward the guide rail 41, the distance between a central point C of the guide rail 41 and the antenna unit 50A or 50B can always be maintained at a predetermined value.

Accordingly, the rollers 55 to 57 do not derail from a predetermined track, so the antenna unit 50A or 50B can track the communication satellite at high precision.

Since the rack gear 41*d* is formed on the guide rail 41 and meshes with the pinion gear 58*a*, even if the guide rail 41 is arcuate or curved, the driving force of the rotary motor 58 can be reliably transmitted through the guide rail 41. When the rack gear 41*d* is integrally molded with the guide rail 41, the manufacturing cost can be reduced greatly.

Because of the presence of the counter weights 44 and 45, a force necessary for rotatably driving the guide unit 40 can be reduced greatly. More specifically, even if the total weight of the guide unit 40 and antenna unit 50A or 50B amounts to several hundred grams, since the counter weights 44 and 45 are added, the holding torque can be set small, and a force necessary for holding the guide rail 41 can be reduced greatly. As a result, the rotary motor 58 can be made compact at low cost.

Since a resin such as syndiotactic polystyrene with a small dielectric constant is used to form the guide rail 41, the intensity distribution of the radio waves which is originally uniform is not adversely affected. A material other than a resin may be used as far as it has a low dielectric constant.

The present invention is not limited to the above embodiment. In the embodiment described above, the transmission mechanism for the driving force of the motor is a meshing mechanism in which a rack gear and pinion gear mesh. However, this mechanism may be replaced by one employing frictional driving. More specifically, a roller having a large frictional force and formed at the output end of a motor, and a guide are brought into tight contact with each other while applying an appropriate preload, and a movable unit is moved along the circumference of the guide. According to still another method, the movable unit may be moved by a wire with a tensile force. More specifically, a wire is fixed to two ends of the movable unit, and the wire is pulled by a motor not incorporated in the movable unit, and a pulley, thereby moving the movable unit.

In the above embodiment, the guide rail is substantially semicircular, and counter weights are provided to the two ends of the guide rail. Alternatively, a guide rail may have an annular shape, the circular portion of the movable range of an antenna unit may have a driving force transmitting function, and the non-movable range of the antenna unit may serve as a counter weight.

The engaging portions are formed to have triangular sections. Alternatively, these sections may have trapezoidal shapes, and the sections of the engaging target portions may have trapezoidal recesses, so that the contact areas between the engaging portions and the engaging target portions increase. Various changes and modifications may naturally be made without departing from the spirit and scope of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A satellite communication antenna apparatus for performing communication with a communication satellite, comprising:

a spherical radio wave lens;

an arcuate guide unit arranged along an outer surface of said radio wave lens and having a central point common with said radio wave lens; and an antenna unit reciprocally movable along said guide unit, wherein said guide unit is made of a material with a low specific dielectric constant, and said guide unit comprises an engaging portion for regulating movement of said antenna unit in an axial direction perpendicularly intersecting a guide direction of said guide unit.

2. An apparatus according to claim 1, wherein the material with the low specific dielectric constant is a resin.

3. An apparatus according to claim 1, wherein said antenna unit has a roller having a rotation center on the axial direction and an engaging target portion, on a surface thereof, to engage with said engaging portion.

4. A satellite communication antenna apparatus for performing communication with a communication satellite, comprising:

a spherical radio wave lens;

an arcuate guide unit arranged along an outer surface of said radio wave lens and having a central point common with said radio wave lens;

an antenna unit reciprocally movable along said guide unit; and an antenna positioning unit for positioning said antenna unit, said antenna positioning unit having a rack gear formed along an extending direction of said guide unit, and a pinion gear which meshes with said rack gear and is driven by a rotary motor incorporated in said antenna unit, wherein said guide unit is made of a material with a low specific dielectric constant.

5. A satellite communication antenna apparatus for performing communication with a communication satellite, comprising:

a spherical radio wave lens;

an arcuate guide unit arranged along an outer surface of said radio wave lens and having a central point common with said radio wave lens;

an antenna unit reciprocally movable along said guide unit;

an antenna positioning unit for positioning said antenna unit;

a guide support for supporting said guide unit to be pivotal about a rotation axis extending through two ends of said guide unit and the central point; and a guide positioning unit for positioning said guide unit at a predetermined angular position.

6. An apparatus according to claim 5, wherein said guide unit has a counter weight on a side opposite to a movable range of said antenna unit.

7. An apparatus according to claim 5, wherein said antenna positioning unit has an antenna position detector for detecting a position of said antenna unit with respect to said guide unit.

8. An apparatus according to claim 7, wherein said antenna position detection unit has a magnetized magnetic body provided to said guide unit, and a magnetic body detection element for detecting said magnetic body provided to said antenna unit.

9. An apparatus according to claim 8, wherein said magnetic body is formed of a small-width component magnetized to have S poles and N poles alternately.

10. An apparatus according to claim 9, wherein said magnetic body is formed into a sheet.

11. An apparatus according to claim 10, wherein said magnetic body detection element outputs a plurality of signals with different phases.

12. An apparatus according to claim 5, wherein said guide unit has, at each of two ends thereof, an end detection unit for detecting that said antenna unit has reached said end.

13. An apparatus according to claim 12, wherein said end detection unit resets position information upon detecting that said antenna unit has reached said end.

14. An apparatus according to claim 5, further comprising:

a rotary positioning unit for positioning said guide support to be rotatable about an axis perpendicularly intersecting the rotation axis.

* * * * *